US009618876B2

(12) United States Patent
Aruga

(10) Patent No.: US 9,618,876 B2
(45) **Date of Patent: *Apr. 11, 2017**

(54) IMAGE FORMING APPARATUS

(71) Applicant: CANON KABUSHIKI KAISHA, Tokyo (JP)

(72) Inventor: Daisuke Aruga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/931,712

(22) Filed: Nov. 3, 2015

(65) Prior Publication Data

US 2016/0124339 A1 May 5, 2016

Related U.S. Application Data

(63) Continuation of application No. 14/138,874, filed on Dec. 23, 2013, now Pat. No. 9,207,559.

(30) Foreign Application Priority Data

Dec. 27, 2012 (WO) ..... PCT/JP2012/083847

(51) Int. Cl.

| | |
|---|---|
| ***G03G 15/04*** | (2006.01) |
| ***G03G 15/043*** | (2006.01) |
| ***G03G 15/01*** | (2006.01) |
| ***G03G 21/16*** | (2006.01) |

(52) U.S. Cl.

CPC ..... *G03G 15/043* (2013.01); *G03G 15/011* (2013.01); *G03G 15/0189* (2013.01); *G03G 15/0409* (2013.01); *G03G 21/1623* (2013.01); *G03G 21/1666* (2013.01); *G03G 2221/1636* (2013.01)

(58) Field of Classification Search

CPC ... G03G 15/04; G03G 15/043; G03G 15/0409
USPC ..... 399/118, 207
See application file for complete search history.

(56) References Cited

U.S. PATENT DOCUMENTS

| | | | | |
|---|---|---|---|---|
| 9,207,559 | B2 * | 12/2015 | Aruga | G03G 15/0409 |
| 2006/0001980 | A1 | 1/2006 | Namba | |
| 2008/0187350 | A1 | 8/2008 | Lim | |
| 2009/0066780 | A1 | 3/2009 | Bannai | |

FOREIGN PATENT DOCUMENTS

| | | | |
|---|---|---|---|
| CN | 1715991 | A | 1/2006 |
| CN | 1940634 | A | 4/2007 |
| CN | 101114147 | A | 1/2008 |

* cited by examiner

*Primary Examiner* — Hoang Ngo
(74) *Attorney, Agent, or Firm* — Canon U.S.A. Inc., IP Division

(57) ABSTRACT

A structure in which a shutter is moved in a first direction by a motor, an opening is provided in the shutter, and the shutter is moved in a second direction using an elastic force of a spring connected to an upper cover of a light scanning device and an inside wall at the opening of the shutter increases the size of the structure of the shutter and the structure of the light scanning device due to the position of the spring. Therefore, a recess is provided in an opposing surface of a cover opposing a shutter, and a spring for sliding the shutter is connected to a connection portion provided at the recess. The recess is provided at a side opposite to the light source units with a polygon mirror being interposed therebetween.

17 Claims, 12 Drawing Sheets

IMAGE FORMING APPARATUS

CROSS-REFERENCE TO RELATED APPLICATIONS

This application is a Continuation of U.S. application Ser. No. 14/138,874 filed Dec. 23, 2013 which claims priority from International Patent Application No. PCT/JP2012/083847, filed Dec. 27, 2012, all of which are hereby incorporated by reference herein in their entirety.

TECHNICAL FIELD

Aspects of the present invention generally relate to an image forming apparatus including a light scanning device including a transparent window for passing a laser beam therethrough, and a mechanism for moving a shutter that covers the transparent window for passing the laser beam therethrough.

BACKGROUND ART

A light scanning device of an electrophotographic image forming apparatus includes a transparent window for transmitting a laser beam, deflected by a polygon mirror, to the outside of the light scanning device. Dust that adheres to the transparent window blocks the laser beam, as a result of which image quality of an output image is reduced. In particular, for the light scanning device that exposes a photoconductor from therebelow in a gravitational direction, toner that has fallen from a developing device due to vibration generated when a cartridge (in which the developing device and the photoconductor are integrated to each other) is removed adheres to the transparent window.

Regarding this issue, PTL 1 describes an image forming apparatus that allows a slit, provided in a light scanning device and that is used for passing a laser beam therethrough, to be dustproof by moving the slit by a shutter moving mechanism. FIG. 8 in PTL 1 illustrates a structure that moves a shutter in a first direction by a motor and that moves the shutter in a second direction using an elastic force of a spring that is connected to an inner wall of an opening provided in the shutter and an upper cover of the light scanning device.

CITATION LIST

Patent Literature

PTL 1: Japanese Patent Laid-Open No. 2007-148276

However, PTL 1 describes a structure in which a spring is mounted to the upper cover of the light scanning device. In the structure in PTL 1, it is necessary to provide a gap for providing the spring at a location between the shutter and the upper cover or to design the structure so that the spring fits in the opening by making the shutter thick. Therefore, the structure of the shutter and the structure of the light scanning device are increased in size.

SUMMARY

With respect to the above, the present invention generally provides an image forming apparatus including a first light source configured to emit a first light beam for exposing a first photoconductor; a second light source configured to emit a second light beam for exposing a second photoconductor; a rotating polygon mirror configured to deflect the first light beam and the second light beam so that the first light beam scans the first photoconductor and the second light beam scans the second photoconductor, the rotating polygon mirror deflecting the first light beam and the second light beam toward opposite sides with the rotating polygon mirror being interposed therebetween; an optical box where the first light source, the second light source, and the rotating polygon mirror are disposed; a cover configured to cover the optical box, the cover including a first transparent window and a second transparent window disposed on opposite sides with the rotating polygon mirror being interposed therebetween, the first transparent window passing therethrough the first light beam deflected by the rotating polygon mirror, the second transparent window passing therethrough the second light beam deflected by the rotating polygon mirror; a shutter that is disposed so as to oppose the cover, the shutter sliding so as to reciprocate between a position where the first transparent window and the second transparent window are covered and a position that is displaced from a light path of the first light beam that has passed through the first transparent window and from a light path of the second light beam that has passed through the second transparent window; and a shutter moving mechanism including pushing means and a spring, the pushing means sliding the shutter by pushing the shutter, the spring being connected to the shutter and the cover, being deformed so that an elastic force that urges the shutter in a direction opposite to a pushing direction of the pushing means increases as an amount of movement of the shutter pushed by the pushing means increases, and sliding the shutter in the opposite direction by the elastic force, wherein an opposing surface of the cover opposing the shutter includes a recess that is provided at a side opposite to the first light source and the second light source with the rotating polygon mirror being interposed therebetween, the recess being recessed towards an inner side of the optical box, covered by the cover, at a location between the first transparent window and the second transparent window, and wherein a connection portion with which the spring connected to the shutter is connected is provided at the recess.

Further features of the present disclosure will become apparent from the following description of exemplary embodiments with reference to the attached drawings.

DESCRIPTION OF EMBODIMENTS

First Embodiment

Image Forming Apparatus

Figure 1:
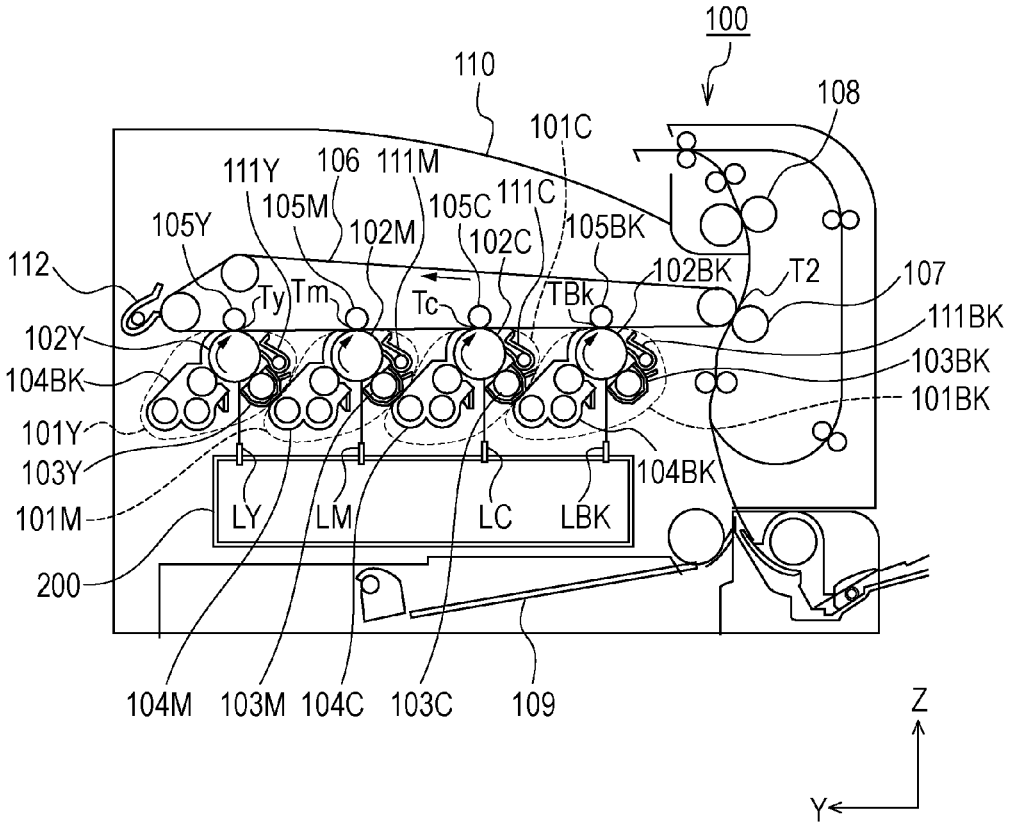
FIG. 1 is a schematic sectional view of an image forming apparatus.

FIG. 1 is a schematic sectional view of an electrophotographic image forming apparatus 100. The image forming apparatus 100 shown in FIG. 1 includes four image forming units 101Y, 101M, 101C, and 101BK for forming toner images of respective colors, yellow, magenta, cyan, and black. The image forming units 101Y, 101M, 101C, and 101BK include photoconductive drums 102Y, 102M, 102C, and 102BK, which are photoconductors, respectively. The image forming units include charging devices 103Y, 103M, 103C, and 103BK that charge the photoconductive drums 102Y, 102M, 102C, and 102BK, respectively; and developing devices 104Y, 104M, 104C, and 104BK that develop electrostatic latent images on the photoconductive drums using toner. The image forming units further include cleaning devices 111Y, 111M, 111C, and 111BK that remove residual toners on the photoconductive drums from the photoconductive drums.

Each image forming unit forms a process cartridge in which the photoconductive drum, charging device, developing device, and cleaning device are integrated to each other. Each process cartridge is a replaceable unit that is capable of being mounted to and removed from the image forming apparatus. The image forming units 101Y, 101M, 101C, and 101BK are hereunder called process cartridges 101Y, 101M, 101C, and 101BK.

A light scanning device 200, transfer rollers 105Y, 105M, 105C, and 105BK, an intermediate transfer belt 106, a cleaning device 112, a sheet feeding unit 109, a sheet discharge section 110, a transfer roller 107, and a fixing device 108 are provided at the body of the image forming apparatus 100. The light scanning device 200 is disposed below the photoconductive drums in a gravitational direction. The light scanning device may be disposed so as to expose the photoconductive drums from thereabove in the gravitational direction.

Next, an image formation process is described. The light scanning device 200 emits light beams LY, LM, LC, and LBK (laser beams) used for exposing the associated photoconductive drums 102Y, 102M, 102C, and 102BK that have been charged by the charging devices 103Y, 103M, 103C, and 103BK, respectively. By exposing the photoconductive drums 102Y, 102M, 102C, and 102BK with the light beams, electrostatic latent images are formed on the photoconductive drums 102Y, 102M, 102C, and 102BK.

The developing device 104Y develops the electrostatic latent image on the photoconductive drum 102Y with yellow toner. The developing device 104M develops the electrostatic latent image on the photoconductive drum 102M with magenta toner. The developing device 104C develops the electrostatic latent image on the photoconductive drum 102C with cyan toner. The developing device 104BK develops the electrostatic latent image on the photoconductive drum 102BK with black toner.

A yellow toner image on the photoconductive drum 102Y is transferred to the intermediate transfer belt 106, serving as an intermediate transfer member, by the transfer roller 105Y at a transfer portion Ty. At a location between a charging portion of the charging device 103Y and the transfer portion Ty in a direction of rotation of the photoconductive drum 102Y, the cleaning device 111Y collects any residual toner on the photoconductive drum 102Y that has not been transferred to the intermediate transfer belt 106.

A magenta toner image on the photoconductive drum 102M is transferred to the intermediate transfer belt 106 by the transfer roller 105M at a transfer portion Tm. At a location between a charging portion of the charging device 103M and the transfer portion Tm in a direction of rotation of the photoconductive drum 102M, the cleaning device 111M collects any residual toner on the photoconductive drum 102M that has not been transferred to the intermediate transfer belt 106.

A cyan toner image on the photoconductive drum 102C is transferred to the intermediate transfer belt 106 by the transfer roller 105C at a transfer portion Tc. At a location between a charging portion of the charging device 103C and the transfer portion Tc in a direction of rotation of the photoconductive drum 102C, the cleaning device 111C collects any residual toner on the photoconductive drum 102C that has not been transferred to the intermediate transfer belt 106.

A black toner image on the photoconductive drum 102BK is transferred to the intermediate transfer belt 106 by the transfer roller 105BK at a transfer portion TBk. At a location between a charging portion of the charging device 103BK and the transfer portion TBk in a direction of rotation of the photoconductive drum 102BK, the cleaning device 111BK collects any residual toner on the photoconductive drum 102BK that has not been transferred to the intermediate transfer belt 106.

The cleaning devices 111Y, 111M, 111C, and 111BK according to the embodiment each include a blade that contacts the associated photoconductive drum, with the blade collecting any residual toner on the associated photoconductive drum by scraping up the residual toner.

The toner images of the respective colors transferred on the intermediate transfer belt 106 are transferred to a recording sheet, which has been transported from the sheet feeding unit 109 by the transfer roller 107, at a transfer portion T2. The toner images transferred to the recording sheet at the transfer portion T2 are fixed by the fixing device 108, and the recording sheet after the fixing operation is discharged to the sheet discharge section 110.

The image forming device 100 includes the cleaning device 112 at a location between the transfer portion Ty and the transfer portion T2 in the direction of rotation of the intermediate transfer belt 106. The cleaning device 112 includes a blade that contacts the intermediate transfer belt 106, and cleans off any residual toner on the intermediate transfer belt 106 that has not been transferred to the recording sheet by scraping up the residual toner on the intermediate transfer belt 106 by the blade.

Collecting Toner Container and Door of Image Forming Apparatus

Figure 2A:
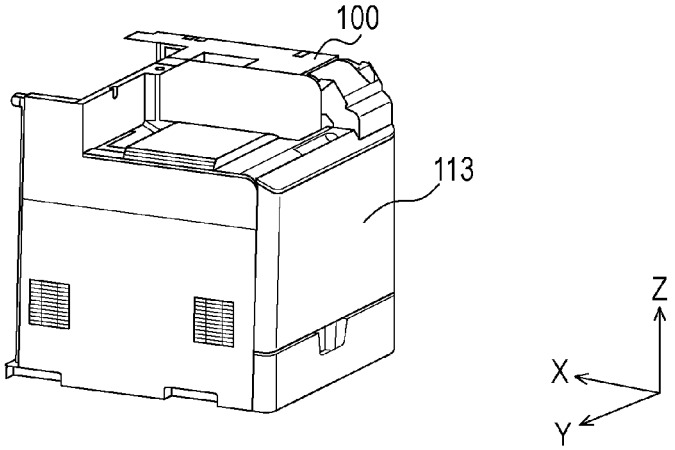
FIGS. 2A-2C are external perspective views of the image forming apparatus.

FIG. 2 is an external perspective view of the image forming apparatus 100. As shown in FIG. 2, the image forming apparatus 100 according to the embodiment includes a maintenance door 113. A collecting toner container 114 is mounted to an inner side of the door 113 of the image forming apparatus 100. Toner collected from the photoconductive drums by the cleaning devices 111Y, 111M, 111C, and 111BK and toner collected from the intermediate transfer belt 106 by the cleaning device 112 accumulate in the collecting toner container 114. The collecting toner container 114 is a replaceable unit that can be mounted to and removed from the body of the image forming apparatus 100. A user replaces the collecting toner container 114 when a display section (not shown) urges the replacement of the collecting toner container 114.

Figure 2B:
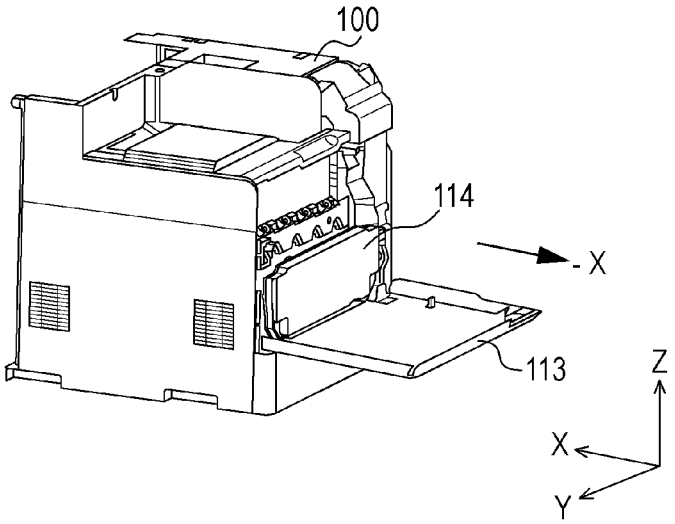
Figure 2C:
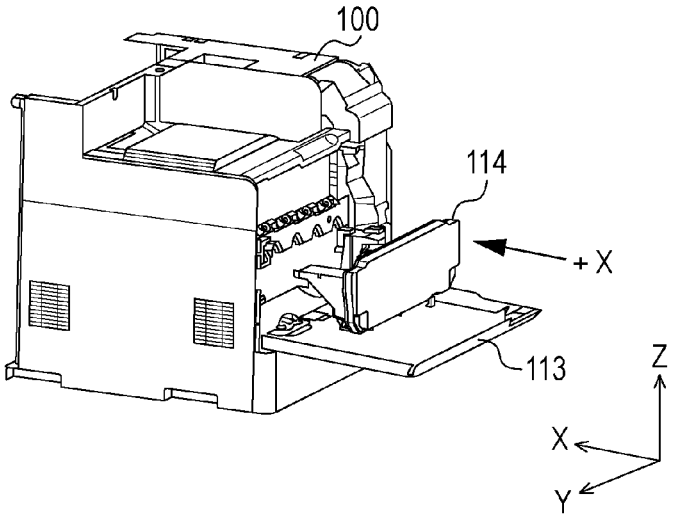

As shown in FIG. 2B, the user removes the collecting toner container 114 from the image forming apparatus 100 by moving the collecting toner container 114, mounted to the image forming apparatus 100, in a −X direction (state in FIG. 2C). In contrast, if the user moves the collecting toner container 114 in a +X direction from the state in FIG. 2C, the collecting toner container 114 is mounted to the image forming apparatus 100 as shown in FIG. 2B. In the state in which the collecting toner container 114 is mounted to the image forming apparatus 100, the user cannot remove the process cartridges.

Collecting Toner Container

Figure 3A:
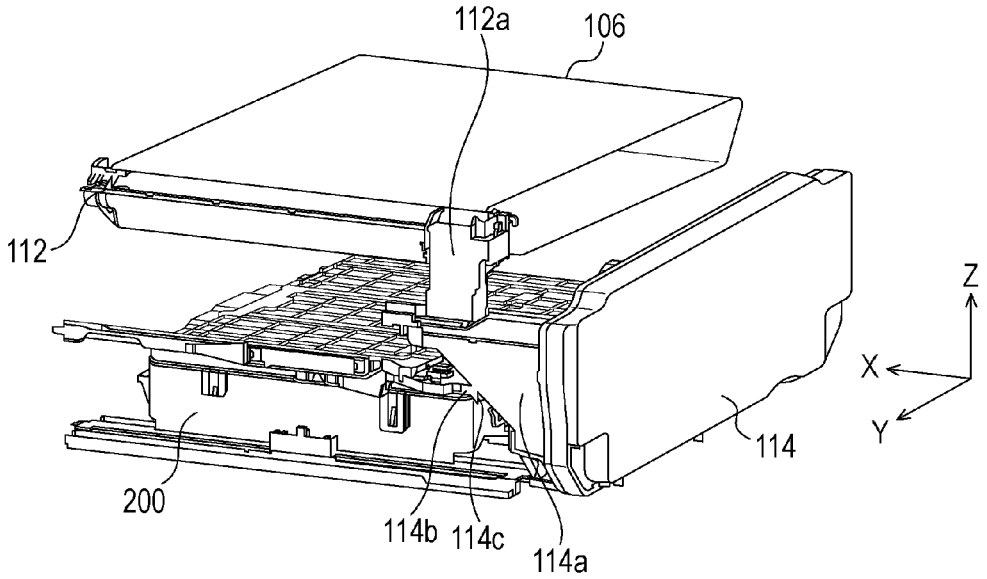
FIGS. 3A and 3B illustrate a state of connection between a collecting toner container and a cleaning device, and are perspective views of the collecting toner container 114.
Figure 3B:
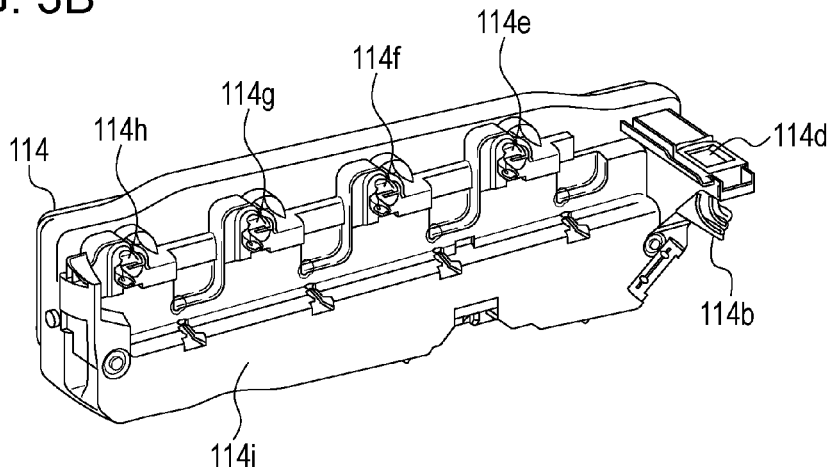

FIG. 3A illustrates a state of connection between the collecting toner container 114 and the cleaning device 112. FIG. 3B is a perspective view of the collecting toner container 114.

As shown in FIG. 3B, a toner transport path 114*a*, which is connected to the cleaning device 112, is integrated to the collecting toner container 114. A toner receiving opening 114*d* into which toner transported from the cleaning device 112 flows is provided at the toner transport path 114*a*. In the state in which the collecting toner container 114 is mounted to the image forming apparatus, the toner receiving opening 114*d* is connected to the toner transport path 112*a* of the cleaning device 112. Toner cleaned off by the cleaning device 112 during image formation moves by a transport screw (not shown), passes through the toner transport path 112*a* at the cleaning device 112 and the toner transport path 114*a* at the collecting toner container 114, and is collected by the collecting toner container 114.

Receiving openings 114*e*, 114*f*, 114*g*, and 114*h* that receive toner transported from the cleaning devices 111Y, 111M, 111C, and 111BK are formed in the collecting toner container 114. The receiving opening 114*e* is connected to the cleaning device 111Y. The receiving opening 114*f* is connected to the cleaning device 111M. The receiving opening 114*g* is connected to the cleaning device 111C. The receiving opening 114*h* is connected to the cleaning device 111BK.

The collecting toner container 114 further includes a toner accumulation portion 114*i* where the toner that has flown in from each of the cleaning devices is accumulated, and a protrusion 114*b*. As shown in FIG. 3B, the protrusion 114*b* includes a first flat surface 114*b*1 (first inclined portion) and a second flat surface 114*b*2 (second inclined portion). The first flat surface 114*b*1 is a flat surface that is inclined with respect to an imaginary plane (XZ plane) parallel to a movement direction (X axis direction) of the collecting toner container 114*b* when the collecting toner container 114*b* is being mounted or removed. The second flat surface 114*b*2 is a flat surface that is formed continuously with the first flat surface 114*b*1 and that is inclined with respect to the imaginary plane. An inclination angle of the second flat surface 114*b*2 with respect to the imaginary plane is less than an inclination angle of the first flat surface 114*b*1 with respect to the imaginary plane. In the embodiment, the angle between the imaginary plane and the second flat surface 114*b*2 is substantially zero degrees. The protrusion 114*b* is described later. The first flat surface 114*b*1 and the second flat surface 114*b*2 may have a substantially linear shape like a V-shaped top portion.

Figure 4A:
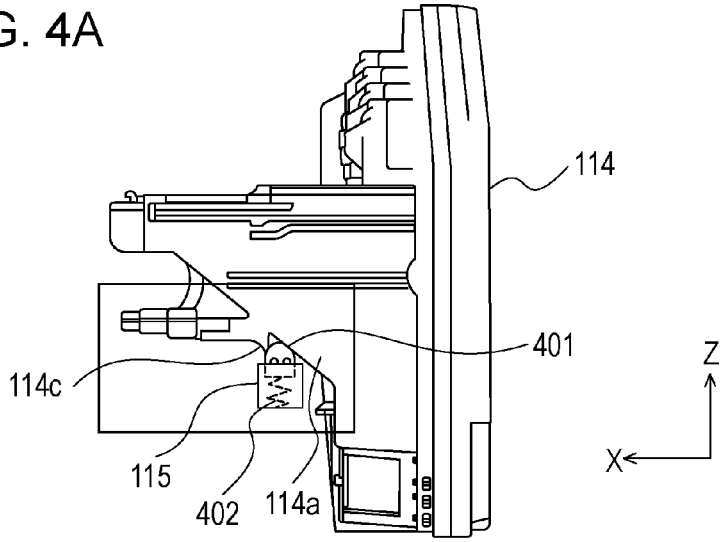
FIGS. 4A-4D illustrate a state in which the collecting toner container is mounted to the image forming apparatus, and is an enlarged view of the vicinity of a toner container holding mechanism.

FIG. 4A illustrates a state in which the collecting toner container 114 is mounted to the image forming apparatus 100. The image forming apparatus 100 includes a toner container holding mechanism 115 (toner container holding portion) that holds the collecting toner container 114 so as to allow a user to easily mount and remove the collecting toner container 114. The toner container holding mechanism 115 includes a contact member 401 and a spring 402. The contact member 401 contacts a protrusion 114*c* (positioning protrusion) of the collecting toner container 114. The spring 402 is mounted to the contact member 401.

Figure 4B:
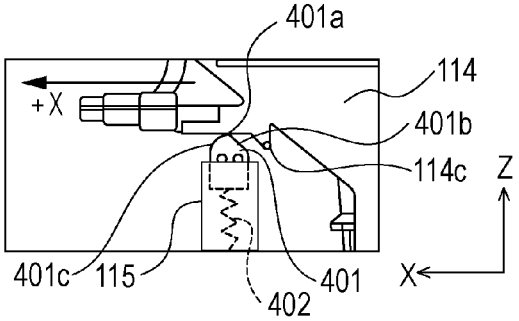
Figure 4C:
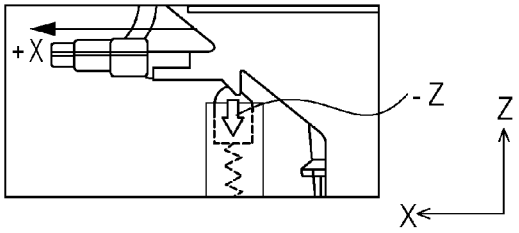
Figure 4D:
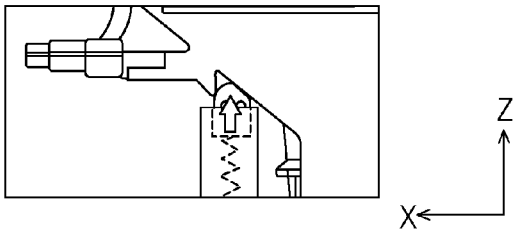

FIGS. 4B to 4D are enlarged views of the vicinity of the toner container holding mechanism 115, and illustrates an example of an operation of the toner container holding mechanism 115 when the collecting toner container 114 is mounted to or removed from the image forming apparatus. FIG. 4B shows a state before the collecting toner container 114 is mounted to a position (predetermined position) where the collecting toner container 114 receives toner from each of the cleaning devices. FIG. 4D shows a state in which the collecting toner container 114 has been mounted to the predetermined position of the image forming apparatus. FIG. 4C shows a state between the state shown in FIGS. 4A and 4D.

As shown in FIG. 4B, the contact member 401 includes a top portion 401*a*, an inclined surface 401*b*, and an inclined surface 401*c*. The inclined surface 401*b* is inclined towards the door 113 from the top portion 401*a*. The inclined surface 401*c* is inclined towards the side where the light scanning device 200 is disposed. When an end where the top portion 401*a* is disposed is defined as one end of the contact member 401, the spring 402 is mounted to the other end of the contact member 401.

When, in order to mount the collecting toner container 114 to the image forming apparatus, a user moves the collecting toner container 114 in a +X direction in FIG. 4B, as shown in FIG. 4C, the positioning protrusion 114*c* of the collecting toner container 114 comes into contact with the inclined surface 401*b*. When the user further moves the collecting toner container 114 in the +X direction, the inclined surface 401*b* pushes the positioning protrusion 114*c*. This compresses the spring 402, and the contact member 401 pushed against the positioning protrusion 114*c* moves towards a −Z direction. When the user further moves the collecting toner container 114 in the +X direction, a lower end of the positioning protrusion 114*c* and the top portion 401*a* are in contact with each other.

When the user further moves the collecting toner container 114 in the +X direction from the state in which the lower end of the positioning protrusion 114*c* and the top portion 401*a* are in contact with each other, the positioning protrusion 114*c* contacts the inclined surface 401*c*, and the contact member 401 moves in a +Z direction shown in FIG. 4D. When the collecting toner container 114 moves up to the predetermined position of the image forming apparatus, as shown in FIG. 4D, the positioning protrusion 114*c* engages with the contact member 401, and restricts the movement of the collecting toner container 114 in the −X direction, so that the collecting toner container 114 is mounted to the predetermined position of the image forming apparatus. A plurality of the toner container holding mechanisms 115 for positioning the collecting toner container 114 with respect to the image forming apparatus are provided at the image forming device at positions other than the positions shown in FIGS. 4A and 4B. The plurality of toner container holding mechanisms reliably hold the collecting toner container 114 at the predetermined position of the image forming apparatus.

Mounting and Removal of Process Cartridges

Figure 5A:
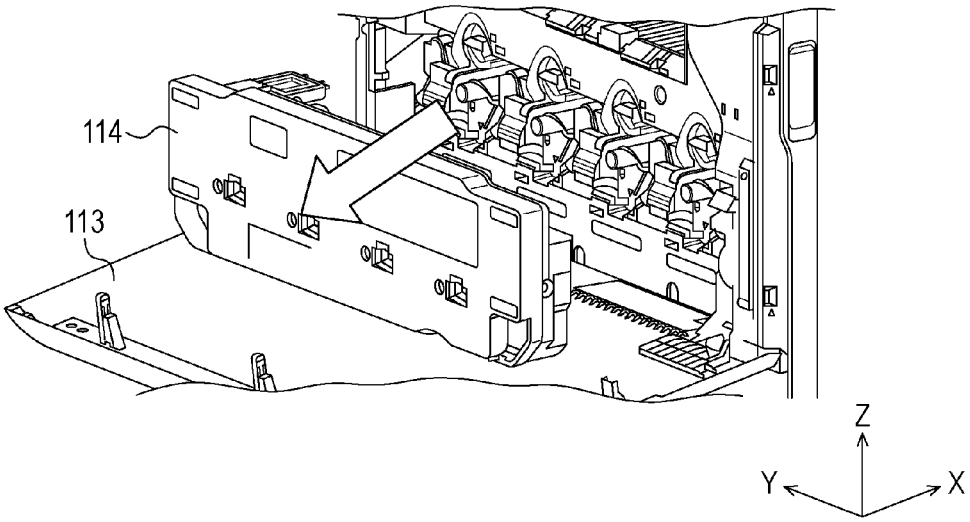
FIGS. 5A and 5B illustrate a structure for mounting and removing process cartridges.
Figure 5B:
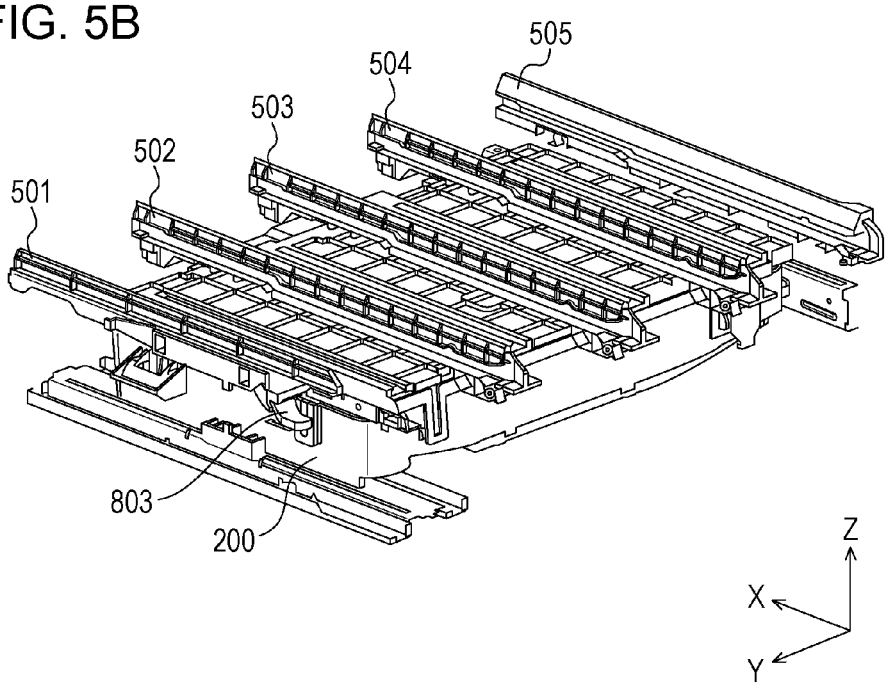

As mentioned above, each of the process cartridges 101Y, 101M, 101C, and 101BK is a replaceable unit that is capable of being mounted to and removed from the body of the image forming apparatus. As shown in FIG. 5B, holding rails 501, 502, 503, 504, and 505 (cartridge holding portions) that hold the process cartridges are provided at the image forming apparatus 100. The holding rails 501 and 502 hold the process cartridge 101Y. The holding rails 501 and 502 function as guide rails (guide members) that guide the movement of the process cartridge in the +X direction or the −X direction when the process cartridge 101Y is being mounted or removed. The holding rail 502 and the holding rail 503 hold the process cartridge 101M. The holding rail 503 and the holding rail 504 hold the process cartridge 101C. The holding rail 504 and the holding rail 505 hold the process cartridge 101BK. The functions of the holding rails 503 to 505 are the same as those of the holding rails 501 and 502, so that they are not described.

When the collecting toner container 114 is mounted to the image forming apparatus, a portion of each process cartridge is covered by the collecting toner container 114. Therefore, in this state, the process cartridges cannot be removed from the image forming apparatus.

When the process cartridges are to be replaced, the user removes the collecting toner container 114 from the image forming apparatus 100 after opening the door 113. When the collecting toner container 114 is removed from the image forming apparatus, as shown in FIG. 5A, the process cartridges 101Y, 101M, 101C, and 101BK are in a state in which they can be slid in the −X direction. The user slides the process cartridges to be replaced in the −X direction, and removes the used process cartridges from the body of the image forming apparatus 100. Thereafter, the user slides new process cartridges in the +X direction and mounts the process cartridges to the body of the image forming apparatus 100. Lastly, the user mounts the collecting toner container 114 to the image forming apparatus 100, and closes the door 113. When the user has performed the above-described steps, the replacement of the process cartridges is completed.

Light Scanning Device

Figure 6A:
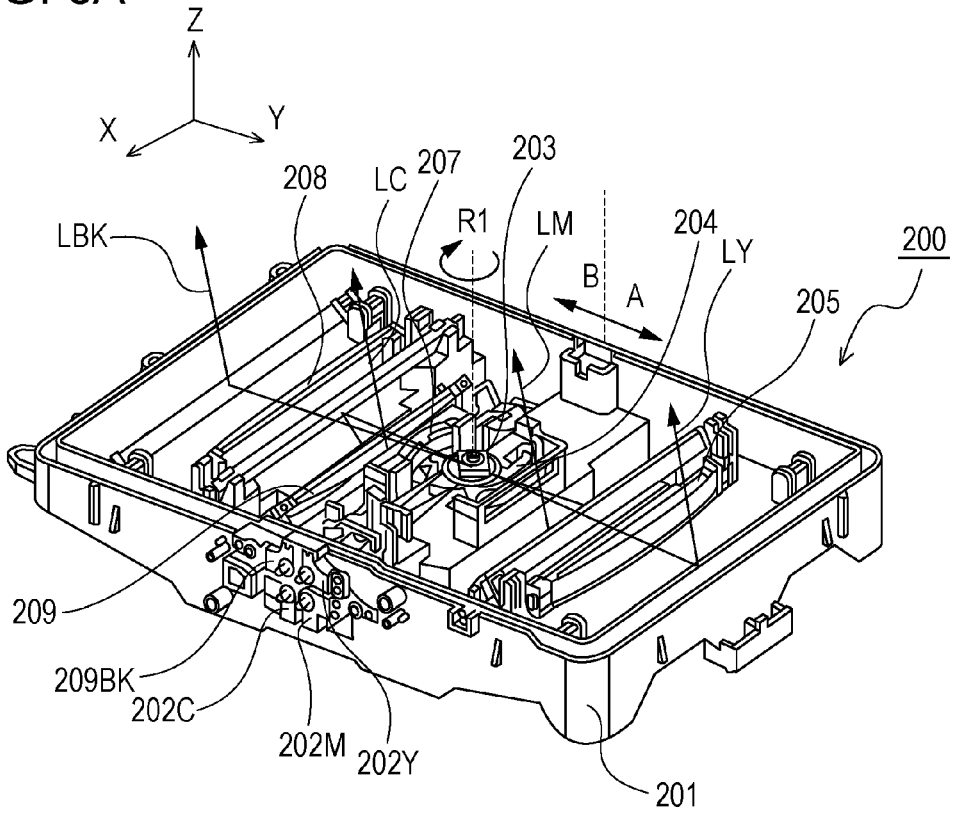
FIGS. 6A and 6B are a perspective view of a structure of a light scanning device and a sectional view of the light scanning device.
Figure 6B:
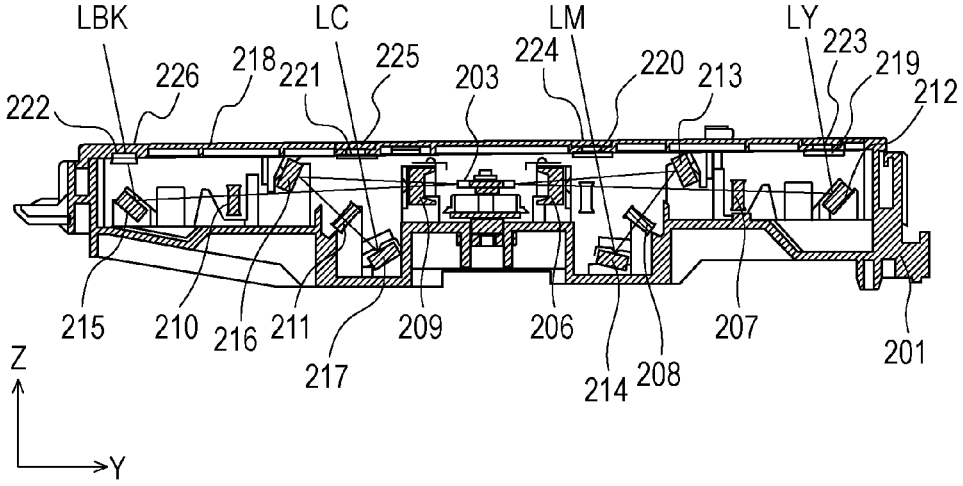

Next, the light scanning device 200 is described. FIG. 6A is a perspective view of a structure of the light scanning device 200, and FIG. 6B is a sectional view of the light scanning device 200.

As shown in FIG. 6A, light source units 202Y, 202M, 202C, and 202BK are mounted to an outer wall (side wall) of an optical box (housing) 201 of the light scanning device 200. The light source unit 202Y, which is a third light source, emits a laser beam LY (third light beam) for exposing the photoconductive drum 102Y, which is a third photoconductor. The light source 202M, which is a first light source, emits a laser beam LM (first light beam) for exposing the photoconductive drum 102M, which is a first photoconductor. The light source unit 202C, which is a second light source, emits a laser beam LC (second light beam) for exposing the photoconductive drum 102C, which is a second photoconductor. The light source unit 202BK, which is a fourth light source, emits a laser beam LBK (fourth light beam) for exposing the photoconductive drum 102BK, which is a fourth photoconductor.

The light source units 202Y, 202M, 202C, and 202BK are disposed close to each other. Here, a plane that crosses a polygon mirror 203 with a rotational axis of the polygon mirror 203 being a normal line is defined as an imaginary plane. The laser beam LY that is emitted from the light source unit 202Y and the laser beam LBK that is emitted from the light source unit 202Bk are incident upon reflection surfaces of the polygon mirror 203 via light paths allowing the laser beams LY and LBK to be obliquely incident upon the imaginary plane from an upper side in a gravitational direction. The laser beam LC that is emitted from the light source unit 202C and the laser beam LM that is emitted from the light source unit 202M are incident upon the reflection surfaces of the polygon mirror 203 via light paths allowing the laser beams LC and LM to be obliquely incident upon the imaginary plane from a lower side in the gravitational direction.

As shown in FIG. 6A, the rotating polygon mirror 203 including four reflection surfaces is disposed at a central portion of the optical box 201. At the time of image formation, the polygon mirror 203 rotates in a direction R1 around a rotation axis shown by a dotted line in FIG. 6A.

The laser beam LY that has been emitted from the light source unit 202Y is incident upon the reflection surface of the polygon mirror 203. The laser beam LY is deflected (reflected) towards a side A shown in FIG. 6A by the reflection surface of the polygon mirror 203. The laser beam LM that has been emitted from the light source unit 202M is incident upon the same reflection surface as the reflection surface of the polygon mirror 203 upon which the laser beam LY is incident. The laser beam LM is deflected by the reflection surface of the polygon mirror 203 towards the same side as the side towards which the laser beam LY is deflected (side A).

The laser beam LBK that has been emitted from the light source unit 202BK is incident upon the reflection surface that differs from the reflection surface upon which the laser beams LY and LM are incident. The laser beam LBK is deflected by the reflection surface of the polygon mirror 203 towards a side B shown in FIG. 6A. The laser beam LC that has been emitted from the light source unit 202C is incident upon the same reflection surface as the reflection surface of the polygon mirror 203 upon which the laser beam LBK is incident. The laser beam LC is deflected by the reflection surface of the polygon mirror 203 towards the same side as the side towards which the laser beam LBK is deflected (side B).

That is, the polygon mirror 203 deflects the laser beam LY and the laser beam LBK towards opposite sides with the polygon mirror 203 being interposed therebetween. The polygon mirror 203 deflects the laser beam LM and the laser beam LC towards opposite sides with the polygon mirror 203 being interposed therebetween.

The laser beams LY and LM deflected by the polygon mirror 203 become laser beams that move in the +X direction. That is, by being deflected by the rotating polygon mirror 203, the laser beam LY becomes a laser beam that scans the photoconductive drum 102Y in the +X direction, and the laser beam LM becomes a laser beam that scans the photoconductive drum 102M in the +X direction.

In contrast, the laser beams LBK and LC deflected by the polygon mirror 203 become laser beams that move in the −X direction. That is, by being deflected by the rotating polygon mirror 203, the laser beam LBK becomes a laser beam that scans the photoconductive drum 102BK in the −X direction, and the laser beam LC becomes a laser beam that scans the photoconductive drum 102C in the −X direction.

Next, the light paths of the laser beams LY, LM, LC, and LBK deflected by the polygon mirror 203 are described using FIG. 6B. As shown in FIG. 6B, optical components, such as the polygon mirror 203, lenses 206, 207, 208, 209, 210, and 211, and reflection mirrors 212, 213, 214, 215, 216, and 217, are mounted to an internal portion of the optical box 201. A cover 218 for protecting the polygon mirror 203, the aforementioned lenses, and the aforementioned mirrors from dust is further mounted to the optical box 201.

After passing through the lens 206 and the lens 207, the laser beam LY deflected by the polygon mirror 203 is incident upon the reflection mirror 212. The reflection mirror 212 reflects the incident laser beam LY towards the photoconductive drum 102Y. The cover 218 includes an opening 219 that passes therethrough the laser beam LY reflected by the reflection mirror 212. The opening 219 is covered by a transparent dust window 223 (third transparent window) that passes therethrough the laser beam LY. The laser beam LY that has passed through the dust window 223 is focused on the photoconductive drum 102Y.

After passing through the lens 206, the laser beam LM deflected by the polygon mirror 203 is incident upon the reflection mirror 213. The reflection mirror 213 reflects the incident laser beam LM towards the lens 208 and the reflection mirror 214. The laser beam LM reflected by the reflection mirror 213 passes through the lens 208 and is incident upon the reflection mirror 214. The reflection mirror 214 reflects the incident laser beam LM towards the photoconductive drum 102M. The cover 218 includes an opening 220 that passes therethrough the laser beam LM reflected by the reflection mirror 214. The opening 220 is covered by a transparent dust window 224 (first transparent window) that passes the laser beam LM therethrough. The laser beam LM that has passed through the dust window 224 is focused on the photoconductive drum 102M.

After passing through the lens 209 and the lens 210, the laser beam LBK deflected by the polygon mirror 203 is incident upon the reflection mirror 215. The reflection mirror 215 reflects the incident laser beam LBK towards the photoconductive drum 102BK. The cover 218 includes an opening 222 that passes therethrough the laser beam LBK reflected by the reflection mirror 215. The opening 222 is covered by a transparent dust window 226 (fourth transparent window) that passes the laser beam LBK therethrough. The laser beam LBK that has passed through the dust window 226 is focused on the photoconductive drum 102BK.

After passing through the lens 209, the laser beam LC deflected by the polygon mirror 203 is incident upon the reflection mirror 216. The reflection mirror 216 reflects the incident laser beam LC towards the lens 211. The laser beam LC reflected by the reflection mirror 211 passes through the lens 211 and is incident upon the reflection mirror 217. The reflection mirror 217 reflects the incident laser beam LC towards the photoconductive drum 102C. The cover 218 includes an opening 221 that passes therethrough the laser beam LC reflected by the reflection mirror 218. The opening 221 is covered by a transparent dust window 225 (second transparent window) that passes the laser beam LC therethrough. The laser beam LC that has passed through the dust window 225 is focused on the photoconductive drum 102C.

Cover

Figure 7A:
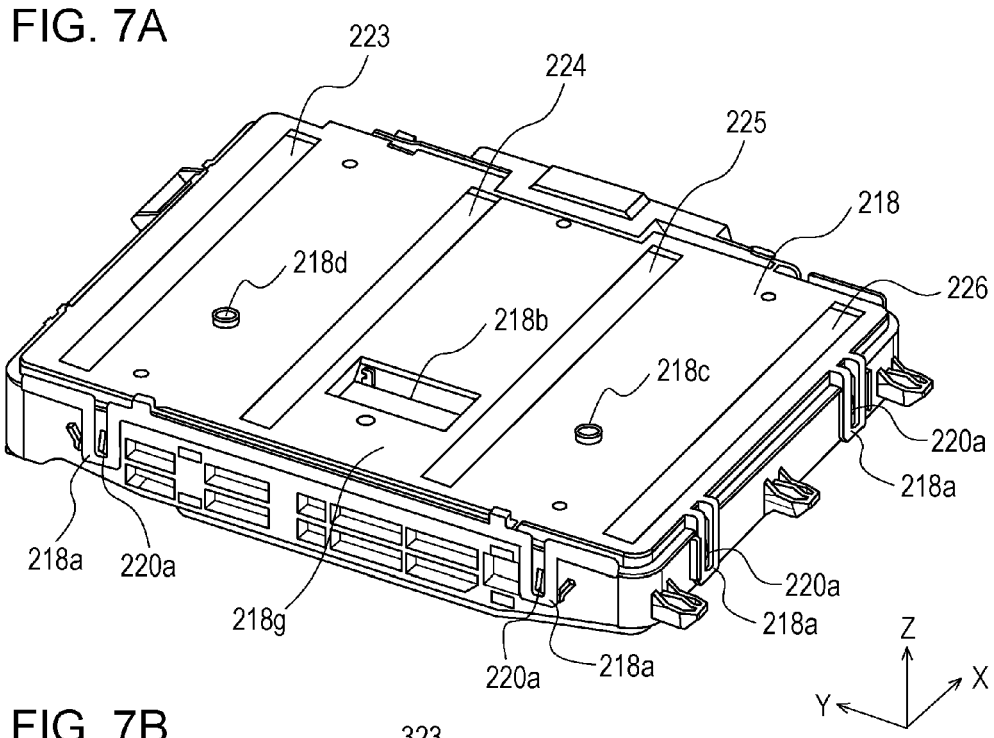
FIGS. 7A and 7B are a perspective view of an optical box and a shutter.

The cover 218 is described. As shown in FIG. 7A, the cover 218 is mounted to the optical box 201 for covering an internal space of the optical box 201. The cover 218 is provided with a plurality of hooks 218*a*. The cover 218 is mounted to the optical box 201 by a snap-fit structure in which the plurality of hooks 218*a* are caused to engage with a plurality of protrusions 220*a* on outer walls of the optical box. As shown in FIG. 7A, the cover 218 includes a recess 218*b*, a protrusion 218*c* (first protrusion), and a protrusion 218*d* (second protrusion) at an opposing surface 218*g* of the cover 218 that opposes a shutter 300. The recess 218*b* is recessed towards an inner side of the optical box 201. The protrusions 218*c* and 218*d* protrude towards an outer side of the optical box 201.

Shutter

Next, the shutter 300 is described. The shutter 300 is a member for preventing foreign substance, such as toner, from adhering to the dust windows 223, 224, 225, and 226. When, in order to maintain the image forming apparatus, a user opens the door 113 and mounts or removes the process cartridges, toner may fall from the cartridges due to the movement of the process cartridges. Therefore, it is desirable that the shutter 300 cover the dust windows 223, 224, 225, and 226 at least when the process cartridges are replaced.

Figure 7B:
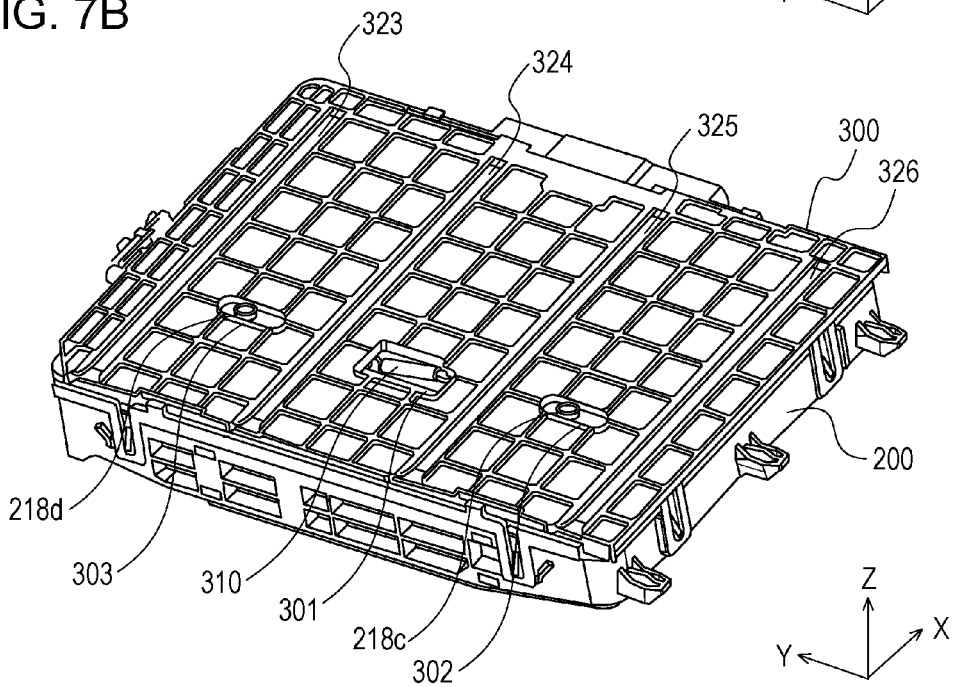

FIG. 7B is a perspective view of the shutter 300 mounted to the light scanning device so as to cover the cover 218. The shutter 300 is a resin member opposing the cover 218 and formed of one continuous plate, and is a common member for covering the dust windows 223, 224, 225, and 226 of the cover 218. The external shape of the shutter 300 according to the embodiment is a rectangular shape that is substantially the same as the external shape of the cover 218 of the light scanning device. The shutter 300 includes an opening 323 for passing therethrough the laser beam LY that has passed through the dust window 223, an opening 324 for passing therethrough the laser beam LM that has passed through the dust window 224, an opening 325 for passing therethrough the laser beam LC that has passed through the dust window 225, and an opening 326 for passing therethrough the laser beam LBK that has passed through the dust window 226 (light beam passing portions). The shutter 300 also includes a slot 301 for mounting a spring 310 serving as an elastic member (described later). The shutter 300 further includes slots 302 and 303. The protrusion 218*c* of the cover 218 is inserted into the slot 302 (first insertion portion). The protrusion 218*d* of the cover 218 is inserted into the slot 303 (second insertion portion). The slots 302 and 303 and the protrusions 218*c* and 218*d* are engagement mechanisms in which the slot 302 and the protrusion 218*c* engage with each other and the slot 303 and the protrusion 218*d* engage with each other. They function as guide mechanisms that limit a movement direction (sliding direction) of the cover 218 to a Y axis direction. Since the slot 302 and the slot 303 are long in a direction parallel to a Y axis of the shutter 300, the slots 302 and 303 and the protrusions 218*c* and 218*d* restrict the movement of the shutter 300 in reciprocating directions that are parallel to the Y axis. The shutter 300 may be mounted to the image forming apparatus.

It is possible to provide the aforementioned protrusions on the shutter 300, the recesses (insertion portions) corresponding to the aforementioned slots in the cover 218, insert the protrusions of the shutter 300 into the recesses, and form guide members.

Shutter Moving Mechanism

The shutter 300 according to the embodiment is provided for suppressing adhesion of dirt, such as toner, to, for example, the dust windows 223, 224, 225, and 226 of the cover 218. The shutter 300 moves by the operation of a mechanism that moves the shutter described below.

Figure 8A:
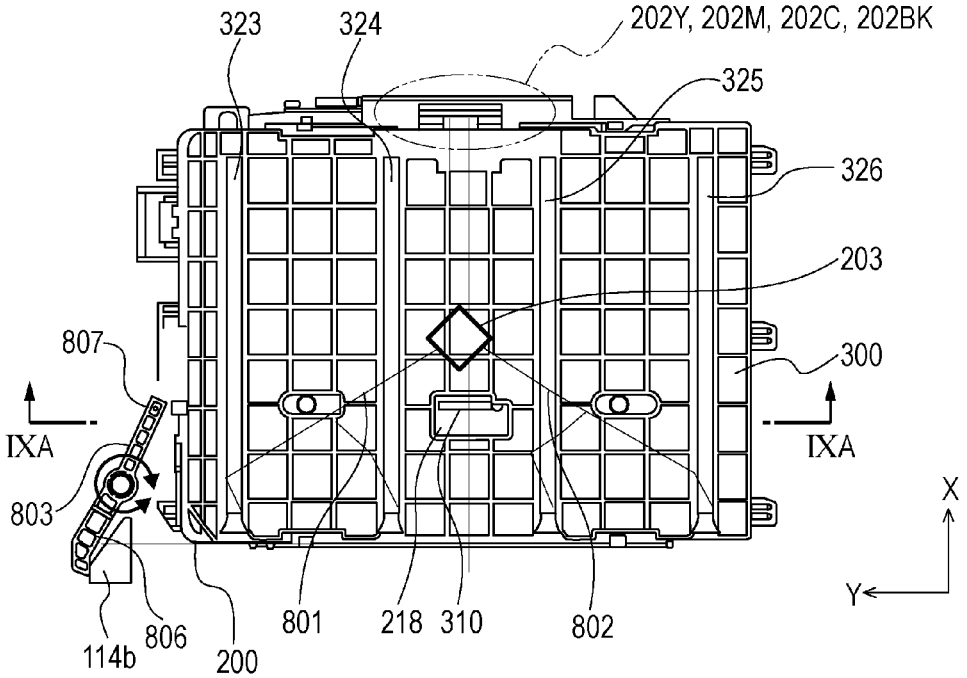
FIGS. 8A and 8B are a top view of the light scanning device, the shutter, and a shutter moving mechanism provided at a body of the image forming apparatus.
Figure 8B:
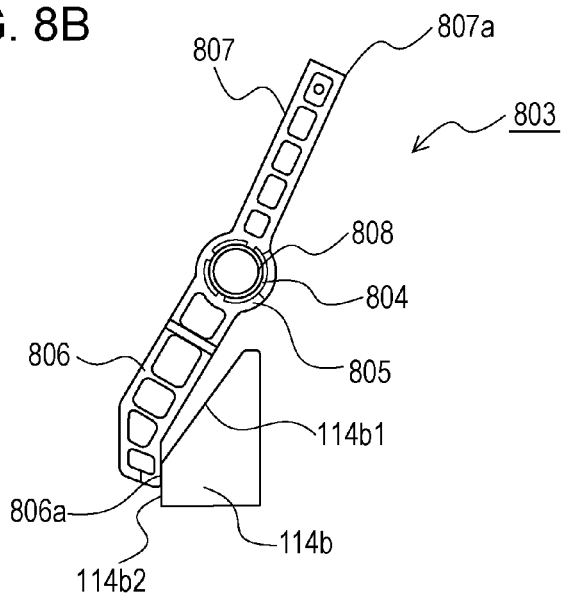

FIG. 8A is a top view of the light scanning device, the shutter, and a shutter moving mechanism provided at the body of the image forming apparatus 100. FIG. 8B is a top view of a rotating mechanism 803 forming part of the shutter moving mechanism.

As shown in FIG. 8B, the rotating mechanism 803 includes a rotary shaft 804, a rotary portion 805, a first arm 806, and a second arm 807. The rotary shaft 804 is a fixed shaft that is provided at the body of the image forming apparatus 100 and that is circular in cross section. The rotary shaft 805, the first arm 806, and the second arm 807 form one rotary member, with the shaft 804 passing through an opening 808 of the rotary portion 805. The first arm 806 and the second arm 807 extend in a radial direction of the shaft 804 from the rotary portion 805.

As shown in FIG. 8A, the rotary member including the rotary portion 805, the first arm 806, and the second arm 807 can rotate clockwise (first rotation direction) and counter-clockwise (second rotation direction that is opposite to the first rotation direction) around the rotary shaft 804 serving as a rotational center (around the center of a circular cross section of the rotary shaft 804 serving as the rotational center).

Next, the spring 310 forming part of the shutter moving mechanism is described using FIG. 9. FIG. 9A is a sectional view along IXA-IXA in FIG. 8A. FIG. 9B is an enlarged perspective view of the recess 218*b* of the cover 218. FIG. 9C is an enlarged perspective view of the slot 301 of the shutter 300. FIG. 9D is an enlarged sectional view at a mounting portion of the spring 310.

Figure 9A:
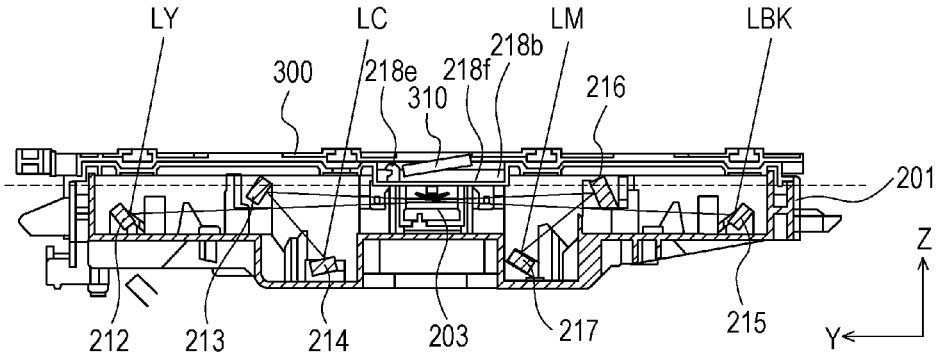
FIGS. 9A-9D illustrate the shutter moving mechanism.
Figure 9B:
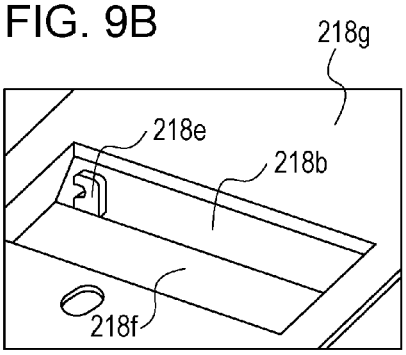
Figure 9C:
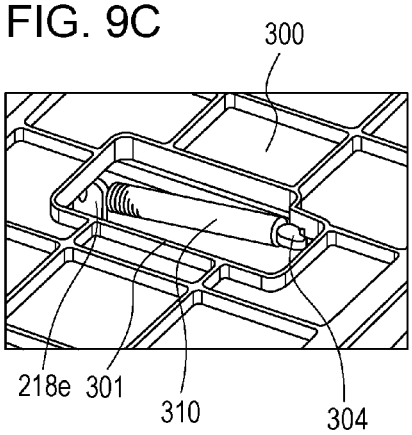
Figure 9D:
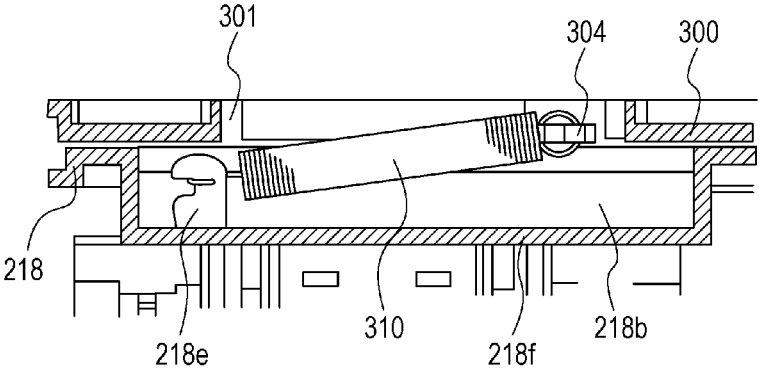

As shown in FIG. 9B, an engagement portion 218*e* (second connection portion) with which one end of the spring 310, such as a coil spring, engages is provided at the recess 218*b* of the cover 218. As shown in FIG. 9C, an engagement portion 304 (first connection portion) with which the other end of the spring 310 engages is provided at the shutter 300. That is, the cover 218 and the shutter 300 are connected to each other by the spring 310.

As shown in FIG. 9A, in a direction of the rotational axis of the polygon mirror 203 (Z axis direction), a bottom surface 218*f* at the recess 218*b* of the cover 218 is provided closer to the bottom surface of the optical box 201 than the dust windows 223, 224, 225, and 226.

The recess 218*b* is provided on an extension line of the light paths of the laser beams that are emitted from the light source units 202Y, 202M, 202C, and 202BK and incident upon the polygon mirror 203. That is, when viewed from the direction of the rotational axis of the polygon mirror 203, the recess 218*b* is provided at a side opposite to the light sources 202Y, 202M, 202C, and 202BK with the polygon mirror 203 being interposed therebetween. A square shape shown in FIG. 8A indicates the position of the rotating polygon mirror. A line segment 801 and a line segment 802 indicate end portions of a scanning region using the laser beams deflected by the polygon mirror 203. Here, the scanning region refers to an effective scanning area corresponding to an area from one end to the other end of an electrostatic latent image that is formed on each photoconductive drum in a direction of a rotational axis of each photoconductive drum. As shown in FIG. 8A, when viewed from the direction of the rotational axis of the polygon mirror 203, the recess 218*b* of the cover 218 is provided in an internal portion of the light scanning device so as to be displaced from the light paths of the respective laser beams deflected by the polygon mirror 203. Therefore, not only is the recess 218*b* displaced from the light paths of the laser beams in the internal portion of the light scanning device, but also the recess 218*b* extends towards the internal portion of the light scanning device so as to exist beyond the positions of the dust windows in the direction of the rotational axis of the polygon mirror 203. The connection portions with which the spring 310 is connected are provided at the bottom surface 218*f* at the recess 218*b*. The spring 310 can be accommodated in the recess 218*b*.

When the recess 218*b* is provided in the opposing surface 218*g* of the cover 218 that opposes the shutter 300, it is not necessary to provide the spring 310 on the opposing surface 218*g*. Therefore, it is possible to prevent the size of the light scanning device 200 from increasing in the direction of the rotational axis of the polygon mirror 203. In addition, since the shutter 300 and the cover 218 can be disposed close to each other, it is possible to prevent the size of the guide members, such as the protrusions 218*c* and 218*d*, from increasing.

Operation of Shutter Moving Mechanism

Next, the operation of the shutter moving mechanism (shutter opening/closing mechanism) is described using FIGS. 10 and 11.

Figure 10A:
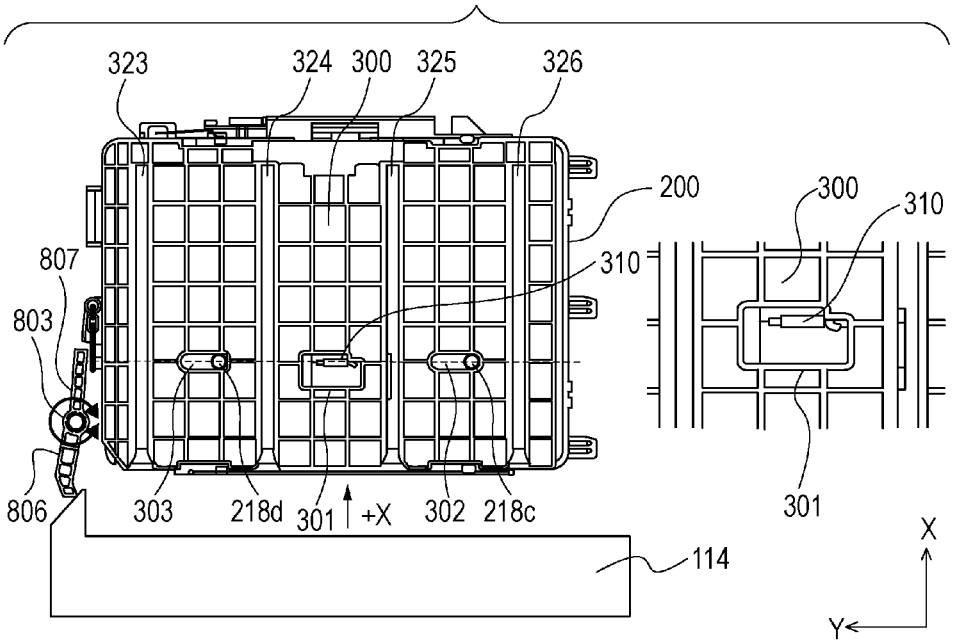
FIGS. 10A and 10B illustrate an operation of the shutter moving mechanism (shutter opening/closing mechanism).

FIG. 10A is a top view of a state before the collecting toner container 114 is mounted to the toner container holding mechanism 115. In FIG. 10A, the shutter 300 covers the openings 223, 224, 225, and 226 of the cover 218, and, even if the laser beams LY, LM, LC, and LBK are emitted, the laser beams are blocked by the shutter. In the embodiment, the state shown in FIG. 10A is a closed state of the shutter in which the shutter 300 blocks the laser beams or a state in which the shutter 300 is at a second position existing on the light paths of the laser beams.

Figure 10B:
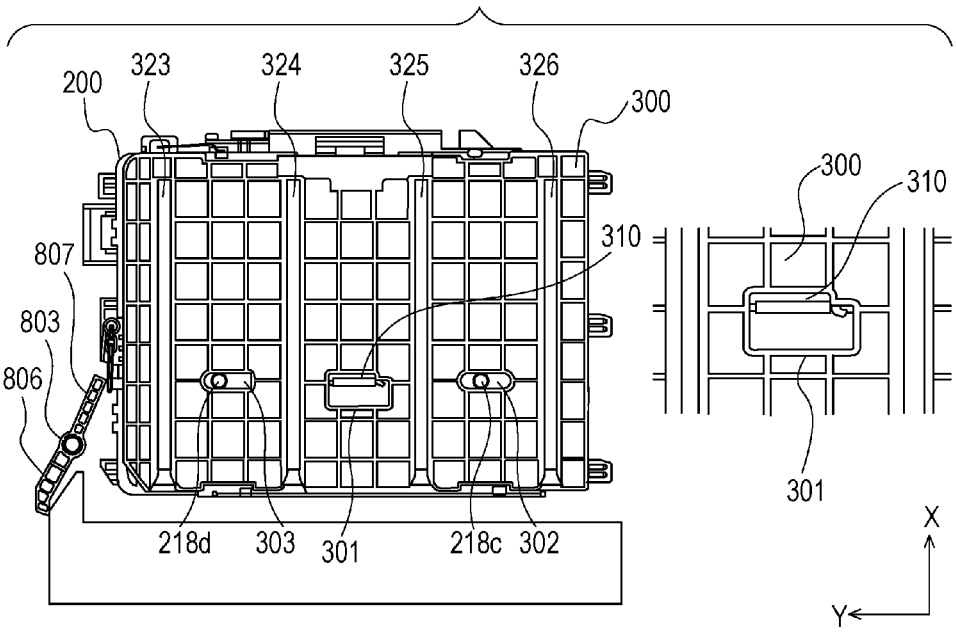

FIG. 10B is a top view of a state in which the collecting toner container 114 is held by the toner container holding mechanism 115. In FIG. 10B, the shutter 300 is positioned at a first position that is displaced from the light paths of the laser beams. Therefore, the laser beams LY, LM, LC, and LBK can pass through the openings 223, 224, 225, and 226 of the shutter 300. In the embodiment, the state shown in FIG. 10A is an open state of the shutter in which the shutter 300 does not block the laser beams.

In the state shown in FIG. 10A, an end portion 806*a* of the first arm 806 (first moving portion) and the protrusion 114*b* of the collecting toner container 114 contact each other, and an end portion 807*a* of the second arm 807 (second moving portion) and an end portion of the shutter 300 contact each other (left figure in FIG. 10A). The right figure in FIG. 10A shows the state of the spring 310 in the state of the left figure in FIG. 10A.

Figure 11A:
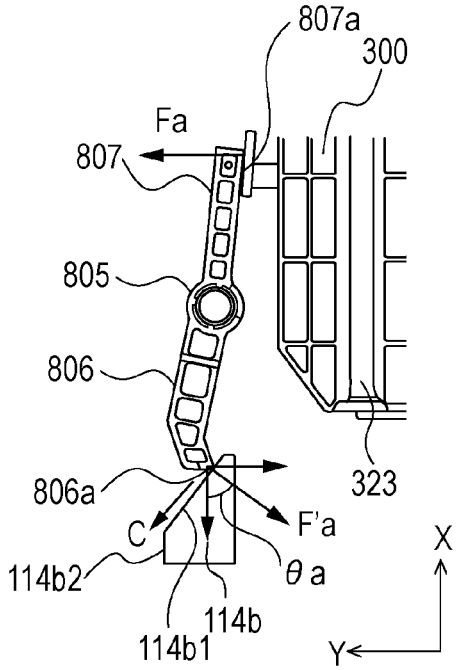
FIGS. 11A-11D illustrate an operation of the shutter moving mechanism (shutter opening/closing mechanism).

FIG. 11A is an enlarged view of the rotary mechanism 803 in the state shown in FIG. 10A. The position of the first arm 806 and the second arm 807 shown in FIG. 11A is an initial position. In the each of the following figures from FIG. 11B to 11D, the initial position of the first arm 806 and the second arm 807 is indicated by a dotted line. In the embodiment, the movement of the shutter in a +Y direction is defined as movement in a first direction, and the movement of the shutter in a −Y direction is defined as a second direction. The movement of the shutter in the +Y direction may be defined as movement in the second direction, and the movement of the shutter in the −Y direction may be defined as movement in the first direction.

When the user moves the collecting toner container 114 in the +X direction from the state shown in FIG. 10A, the end portion 806*a* of the first arm 806 moves in the direction of arrow C on the first flat surface 114*b*1 of the protrusion 114*b*. By moving the end portion 806*a* of the first arm 806 in the direction of arrow C, the first arm 806 rotates (moves) clockwise around the rotary shaft 804 serving as a rotational center, and, at the same time, the second arm 807 also rotates (moves) clockwise around the rotary shaft 804 (FIG. 11B).

The shutter 300 that has been pushed by the end portion 807*a* of the second arm 807 rotated (moved) by the rotation of the first arm 806 slides in the −Y direction (short side direction of the transparent windows). When the shutter 300 slides in the −Y direction from the state shown in FIG. 11A, the spring 310 is stretched. The elastic force of the spring 310 (the urging force of the spring 310 that urges the shutter 300 in the + direction) increases the amount of movement of the shutter 300 in the −Y direction. The elastic force of the spring 310 acts upon the shutter 300 in the +Y direction. Therefore, the state of contact between the shutter 300 and the end portion 807*a* of the second arm 807 is maintained.

Figure 11B:
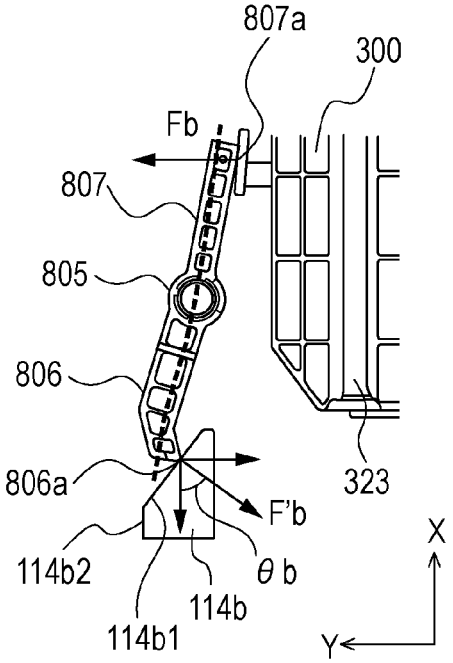

When the user further moves the collecting toner container 114 in the +X direction from the state shown in FIG. 11B, the movement of the collecting toner container 114 in the +X direction causes the first arm 806 and the second arm 807 to rotate clockwise. Then, the shutter 300 pushed by the second arm 807 further slides in the −Y direction (FIG. 11C).

Figure 11C:
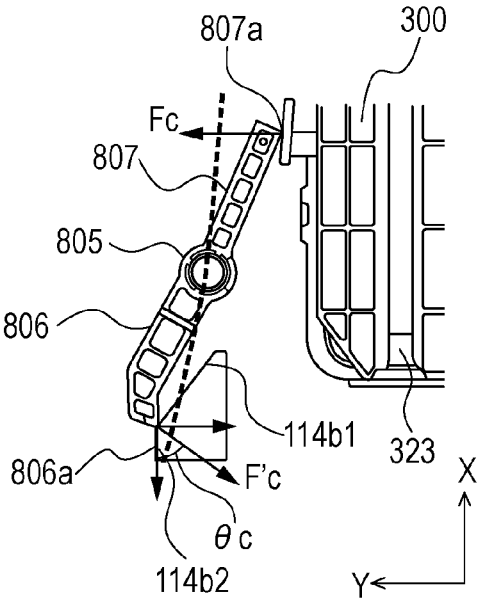

In the state shown in FIG. 11C, the collecting toner container 114 is not completely held by the toner container holding mechanism 115 of the image forming apparatus 100, and can further move in the +X direction. When the user further moves the collecting toner container 114 in the +X direction from the state shown in FIG. 11C, the end portion 806*a* of the first arm 806 comes into contact with the second flat surface 114*b*2 of the protrusion 114*b*. The second flat surface 114*b*2 is a flat surface that is parallel to the X axis. Therefore, even if the end portion 806*a* of the first arm 806 moves on the second flat surface 114*b*, the first arm 806 and the second arm 807 do not rotate in the clockwise/counter-clockwise direction.

Figure 11D:
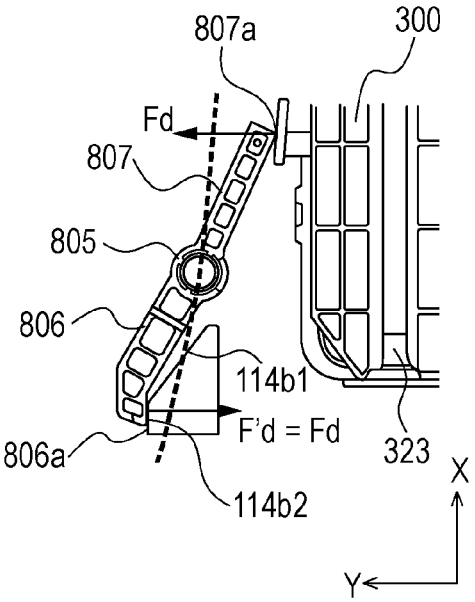

When a contact point between the first arm 806 and the second flat surface 114*b*2 of the protrusion 114*b* is at the position shown in FIG. 11D, as shown in FIG. 4D, the collecting toner container 114 is held by the toner container holding mechanism 115. By forming the second flat surface 114*b*2 parallel to the X axis, in the state in which the end portion 806*a* of the first arm 806 and the second flat surface 114*b*2 contact each other, a force in the −X direction does not act upon the protrusion 114*b* from the end portion 806*a* of the first arm 806. By forming the second flat surface 114*b*2 in this way, it is possible to, in the state shown in FIG. 4D, suppress separation of the collecting toner container 114 from the toner holding mechanism 115 in the −X direction caused by, for example, vibration.

As shown in FIGS. 10A and 10B, in the image forming apparatus according to the embodiment, regardless of the position of the shutter 300 in the Y axis direction, a contact portion (first contact portion) between the second arm 807 and the shutter 300, the engagement portion 304, which is a contact portion (second contact portion), between the shutter 300 and the spring 310, and a contact portion between the spring 310 and the cover 218 are disposed substantially on a straight line (dotted line in FIG. 10A). By such a structure, the direction in which a force acts on the shutter 300 from the second arm 807 and the direction in which a force acts on the shutter 300 from the spring 310 are substantially on the same straight line (dotted line shown in FIG. 10A). Therefore, the generation of a rotation moment with respect to the shutter 300 caused by the forces acting upon the shutter 300 from the second arm 807 and the spring 310 is suppressed. Consequently, it is possible to reduce the load caused by the rotation of the shutter 300 on the engagement mechanism, which includes the protrusion 218*c*, inserted in the slot 302, and the protrusion 218*d*, inserted in the slot 303. Since the load acting upon the protrusion 218*c* and the protrusion 218*d* is reduced, it is possible to suppress deformation of the light scanning device including the cover 218. As a result, it is possible to suppress a reduction in image quality caused by variations in the light paths of the laser beams resulting from the deformation of the light scanning device.

In the image forming apparatus according to the embodiment, the protrusion 218*c* inserted in the slot 302 and the protrusion 218*d* inserted in the slot 303 are disposed on the dotted line shown in FIG. 10A. By such a structure, it is possible to suppress the conversion of a pushing force of the second arm 807 that pushes the shutter 300 in the −Y direction into forces that act upon the protrusion 218*c* and the protrusion 218*d* in the X axis direction from the slot 302 and the slot 303 of the shutter 300, respectively. In addition, it is possible to suppress the conversion of an elastic force of the spring 310 that urges the shutter 300 in the −Y direction into forces that act upon the protrusion 218*c* and the protrusion 218*d* in the X axis direction from the slot 302 and the slot 303 of the shutter 300, respectively. That is, since it is possible to suppress the generation of forces that act upon the protrusion 218*c* and the protrusion 218*d* in the X axis direction when moving the shutter 300, it is possible to suppress the deformation of the light scanning device 200 (in particular, the cover 218).

In the X axis direction, the position of the contact portion between the second arm 807 and the shutter 300 changes slightly by the rotation of the second arm 807. Therefore, the image forming apparatus according to the embodiment is designed so that the range in which the contact portion between the second arm 807 and the shutter 300 moves as the second arm 807 moves is within the widths between both ends of the slots in the X axis direction. In the embodiment, as long as the range in which the contact portion between the second arm 807 and the shutter 300 moves is within the widths between both ends of the slots in the X axis direction, the contact portion between the second arm 807 and the shutter 300, the engagement portion 218*e* serving as the contact portion between the shutter 300 and the spring 310, and the engagement portion 304 serving as the contact portion between the spring 310 and the cover 218 are defined as being substantially on a straight line.

In the embodiment, the protrusion 218*d* is provided between the dust window 224 and the dust window 223 of the cover 218, and the protrusion 218*c* is provided between the dust window 225 and the dust window 226. In addition, the slot 303 is provided between the opening 323 and the opening 324 of the shutter 300, the slot 302 is provided between the opening 325 and the opening 326, and the opening 301 is provided between the opening 324 and the opening 325. By such a structure, regardless of the position of the shutter 300 in the Y axis direction, the contact portion between the second arm 807 and the shutter 300, the engagement portion 304 serving as the contact portion between the shutter 300 and the spring 310, the engagement portion 218*e* serving as the contact portion between the spring 310 and the cover 218, the protrusion 218*c* inserted in the slot 302, and the protrusion 218*d* inserted in the slot 303 can be disposed substantially on a straight line.

Figure 12:
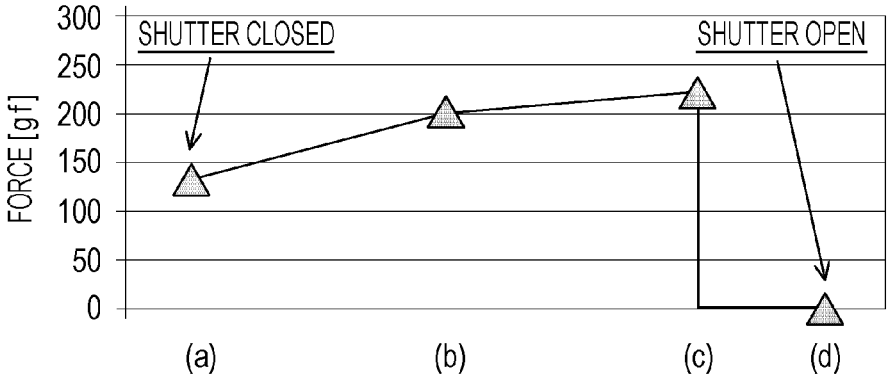
FIG. 12 illustrates the advantageous effects provided by the shutter moving mechanism according to a first embodiment.

FIG. 12 shows the magnitude of a force in the −X direction that acts upon the collecting toner container 114 from the first arm 806. (a) to (d) indicated along the horizontal axis of FIG. 12 corresponds to FIGS. 11A to 11D, respectively. In the state shown in FIG. 11A, an elastic force of the spring 310 that urges the shutter 300 by stretching of the spring 310 causes a force Fa in the +Y direction to act on the second arm 807 from the shutter 113, and a force F'a corresponding to the force Fa to act upon the first flat surface 114*b*1 from the first contact portion 806*a* of the first arm 806. When an angle between the X axis direction and the direction in which F'a acts at this time is θb, a force F'a ×cos θa acts in the −X direction upon the collecting toner container 114 in the state shown in FIG. 11A. In the structure according to the embodiment, a force of approximately 130 gf acts in the −X direction upon the collecting toner container 114 in the state shown in FIG. 11A.

When the user moves the collecting toner container 114 in the +X direction from the state shown in FIG. 11A, the elastic force of the spring 310 that urges the shutter 300 by the stretching of the spring is increased, so that a force Fb (FIG. 11B) and a force Fc (FIG. 11C) that are larger than Fa act upon the second arm from the shutter 113 (Fa<Fb<Fc). Therefore, a force F'b corresponding to Fb and a force F'c corresponding to Fc act upon the first flat surface 114*b*1 from the first contact portion 806*a* of the first arm 806. In the state shown in FIG. 11B, a force F'b×cos θb acts upon the collecting toner container 114 in the −X direction and, in the state shown in FIG. 11C, a force F'c×cos θc acts upon the collecting toner container 114 in the −X direction. In the structure according to the embodiment, in the state shown in FIG. 11B, a force of approximately 200 gf acts upon the collecting toner container 114 in the −X direction and, in the state shown in FIG. 11C, a force of approximately 210 gf acts upon the collecting toner container 114 in the −X direction.

Since, in the state shown in FIG. 11D, the second flat surface 114*b*2 and the contact portion 806*a* of the first arm 806 contact each other, the force that acts upon the collecting toner container 114 in the −X direction is 0 gf. Therefore, in FIG. 11D, the collecting toner container 114 is in a state in which it is unlikely to fall from the toner container holding mechanism 115. The second flat surface 114*b*2 need not be necessarily parallel to the X axis. It is desirable that the inclination angle of the second flat surface 114*b*2 be smaller than the inclination angle of the first flat surface 114*b*1 with respect to the X axis. The contact portion 806*a* need not be formed of only two flat surfaces, such as the first flat surface 114*b*1 and the second flat surface 114*b*2. The contact portion 806*a* may be formed of three or more flat surfaces. The shape of the contact portion 806*a* may be curved so that the inclination angle becomes a gentle angle in the −X direction with respect to an imaginary plane.

As described above, the recess 218*b* is formed in the opposing surface 218*g* of the cover 218 opposing the shutter 300, and the spring 310 for sliding the shutter 300 is connected to the connection portion 218*e* at the recess 218*b*. Therefore, it is possible to prevent the size of the structure of the shutter 300 and that of the light scanning device from increasing.

According to the image forming apparatus of the present embodiment, it is possible to prevent the structure of the shutter and the structure of the light scanning device from increasing in size by providing a recess in an opposing surface of the cover opposing the shutter and connecting the spring for sliding the shutter to a connection portion provided at the recess.

The above-described embodiment is not seen to be limiting, and various changes and modifications can be made without departing from the spirit and scope of the present disclosure.

The invention claimed is:

1. An image forming apparatus comprising:

a light source configured to emit a light beam for exposing a photoconductor;

a rotating mirror configured to deflect the light beam so that the light beam scans the photoconductor;

an optical box where the light source and the rotating mirror are disposed;

a cover attached to the optical box, the cover including a transparent window which the light beam deflected by the rotating mirror passing therethrough and a recess at which a connection portion is provided;

a shutter which slides so as to reciprocate between a position on a light path of the light beam that has passed through the transparent window and a position off the light path of the light beam that has passed through the transparent window;

a shutter moving mechanism including pushing unit and a spring, the pushing unit pushes the shutter to slide, the spring being connected to the connection portion and the shutter so as to urge the shutter in a direction opposite to a pushing direction of the pushing unit, and sliding the shutter in the opposite direction by elastic force;

wherein the recess is recessed toward an inner side of the optical box, and the recess is further recessed than a position of a surface of the cover which is disposed on an extension of a rotational axis of the mirror.

2. The image forming apparatus according to claim 1, wherein, when viewed from a direction of a rotational axis of the rotating mirror, the recess is provided at a position other than a scanning area of the light beam deflected by the rotating mirror.

3. The image forming apparatus according to claim 1, wherein, when viewed from a direction of a rotational axis of the rotating mirror, the recess is provided at a side opposite to the light source with the rotating mirror, and at a position other than a scanning area of the light beam deflected by the rotating mirror.

4. The image forming apparatus according to claim 1, further including a guide mechanism including a protrusion and an insertion portion, the protrusion being provided on an outer surface of the cover, the insertion portion being provided at the shutter and receiving the protrusion, the guide mechanism restricting a sliding direction of the shutter by the protrusion inserted in the insertion portion, wherein a first contact portion between the shutter and the pushing unit that pushes the shutter, a connection portion between the shutter and the spring, the connection portion between the cover and the spring, and the protrusion are positioned substantially on a straight line.

5. The image forming apparatus according to claim 1, further comprising a guide mechanism including a protrusion and an insertion portion, the protrusion being provided on the shutter, the insertion portion being provided at the outer surface of the cover, the insertion portion receiving the protrusion, the guide mechanism restricting a sliding direction of the shutter by the protrusion inserted in the insertion portion, wherein a first contact portion between the shutter and the pushing unit that pushes the shutter, a connection portion between the shutter and the spring, the connection portion between the cover and the spring, and the protrusion are positioned substantially on a straight line.

6. The image forming apparatus according to claim 1, further including another light source configured to emit another light beam for exposing another photoconductor, wherein the cover includes another transparent window which the another light beam deflected by the rotating mirror passing therethrough, and wherein the shutter slides so as to reciprocate between a position on the light path of the light beam that has passed through the transparent window and on an another light path of the another light beam that has passed through the another transparent window and a position off the light path of the light beam that has passed through the transparent window and off the another light path of the another light beam that has passed through the another transparent window.

7. The image forming apparatus according to claim 6, wherein, when viewed from a direction of a rotational axis of the rotating mirror, the recess is provided at a position other than a scanning area of the light beam deflected by the rotating mirror.

8. The image forming apparatus according to claim 6, wherein, when viewed from a direction of a rotational axis of the rotating mirror, the recess is provided at a side opposite to the light source with the rotating mirror, and at a position other than a scanning area of the light beam deflected by the rotating mirror.

9. The image forming apparatus according to claim 6, further including a guide mechanism including a protrusion and an insertion portion, the protrusion being provided on an outer surface of the cover, the insertion portion being provided at the shutter and receiving the protrusion, the guide mechanism restricting a sliding direction of the shutter by the protrusion inserted in the insertion portion, wherein a first contact portion between the shutter and the pushing unit that pushes the shutter, a connection portion between the shutter and the spring, the connection portion between the cover and the spring, and the protrusion are positioned substantially on a straight line.

10. The image forming apparatus according to claim 6, further comprising a guide mechanism including a protrusion and an insertion portion, the protrusion being provided on the shutter, the insertion portion being provided at the outer surface of the cover, the insertion portion receiving the protrusion, the guide mechanism restricting a sliding direction of the shutter by the protrusion inserted in the insertion portion, wherein a first contact portion between the shutter and the pushing unit that pushes the shutter, a connection portion between the shutter and the spring, the connection portion between the cover and the spring, and the protrusion are positioned substantially on a straight line.

11. The image forming apparatus according to claim 1, wherein, in a vertical direction, the optical box, the shutter, and the shutter moving mechanism are disposed at a lower side of the photoconductor.

12. An image forming apparatus comprising:

a light source configured to emit a light beam for exposing a photoconductor;

a rotating mirror configured to deflect the light beam so that the light beam scans the photoconductor;

a plurality of optical members configured to guide the light beam deflected by the rotating mirror to the photoconductor;

an optical box where the rotating mirror and the plurality of optical members are disposed;

a cover configured to attach to the optical box, the cover including a transparent window which the light beam deflected by the rotating mirror passing therethrough;

a shutter that is disposed so as to oppose the cover, the shutter sliding so as to reciprocate between a position on a light path of the light beam that has passed through the transparent window and a position off the light path of the light beam that has passed through the transparent window;

a shutter moving mechanism including pushing unit and a spring, the pushing unit sliding the shutter by pushing the shutter, the spring being connected to the shutter and the cover, being deformed so that an elastic force that urges the shutter in a direction opposite to a pushing direction of the pushing unit increases as an amount of movement of the shutter pushed by the pushing unit increases, and sliding the shutter in the opposite direction by the elastic force;

a recess disposed to the cover and being recessed towards an inner side of the optical box; and a connection portion provided at the recess and with which the spring connected to the shutter is connected, wherein the recess is provided at a position other than a scanning area of the light beam deflected by the rotating mirror, and wherein the connection portion that erects from a bottom of the recess is provided, in a direction of a rotational axis of the mirror, in a position overlapping at least one of an optical member within the plurality of the optical members.

13. The image forming apparatus according to claim 12, further including another light source configured to emit another light beam for exposing another photoconductor, wherein the cover includes another transparent window which the another light beam deflected by the rotating mirror passing therethrough, and wherein the shutter slides so as to reciprocate between a position on the light path of the light beam that has passed through the transparent window and on an another light path of the another light beam that has passed through the another transparent window and a position off the light path of the light beam that has passed through the transparent window and off the another light path of the another light beam that has passed through the another transparent window.

14. The image forming apparatus according to claim 12, wherein, in a vertical direction, the optical box, the shutter, and the shutter moving mechanism are disposed at a lower side of the photoconductor.

15. An image forming apparatus comprising:

a light source configured to emit a light beam for exposing a photoconductor;

a rotating mirror configured to deflect the light beam so that the light beam scans the photoconductor;

a plurality of optical members configured to guide the light beam deflected by the rotating mirror to the photoconductor;

an optical box where the rotating mirror and the plurality of optical members are disposed;

a cover configured to attach to the optical box, the cover including a transparent window which the light beam deflected by the rotating polygon mirror passing therethrough;

a shutter that is disposed so as to oppose the cover, the shutter sliding so as to reciprocate between a position on a light path of the light beam that has passed through the transparent window and a position off the light path of the light beam that has passed through the transparent window;

a shutter moving mechanism including pushing unit and a spring, the pushing unit sliding the shutter by pushing the shutter, the spring being connected to the shutter and the cover, being deformed so that an elastic force that urges the shutter in a direction opposite to a pushing direction of the pushing unit increases as an amount of movement of the shutter pushed by the pushing unit increases, and sliding the shutter in the opposite direction by the elastic force;

a recess disposed to the cover and being recessed towards an inner side of the optical box; and a connection portion provided at the recess and with which the spring connected to the shutter is connected, wherein the recess is provided at a position other than a scanning area of the light beam deflected by the mirror, and wherein, in a direction of a rotational axis of the mirror, base of the connection portion that erects from bottom of the recess is provided closer to a bottom side of the optical box than the transparent window.

16. The image forming apparatus according to claim 15, further including another light source configured to emit another light beam for exposing another photoconductor, wherein the cover includes another transparent window which the another light beam deflected by the rotating mirror passing therethrough, and wherein the shutter slides so as to reciprocate between a position on the light path of the light beam that has passed through the transparent window and on an another light path of the another light beam that has passed through the another transparent window and a position off the light path of the light beam that has passed through the transparent window and off the another light path of the another light beam that has passed through the another transparent window.

17. The image forming apparatus according to claim 15, wherein, in a vertical direction, the optical box, the shutter, and the shutter moving mechanism are disposed at a lower side of the photoconductor.

* * * * *